US009596891B2

(12) United States Patent
Deal et al.

(10) Patent No.: US 9,596,891 B2
(45) Date of Patent: Mar. 21, 2017

(54) ADHESIVE BRA CONSTRUCTION FOR DEEP PLUNGE APPAREL

(71) Applicants: Beverly Ann Deal, Austin, TX (US); Rebecca Harmon, Austin, TX (US); Kevin Lee, Monterey Park, CA (US)

(72) Inventors: Beverly Ann Deal, Austin, TX (US); Rebecca Harmon, Austin, TX (US); Kevin Lee, Monterey Park, CA (US)

(73) Assignee: Ce Soir Lingerie Co., Inc., Austin, TX (US)

( * ) Notice: Subject to any disclaimer, the term of this patent is extended or adjusted under 35 U.S.C. 154(b) by 0 days.

(21) Appl. No.: 15/065,544

(22) Filed: Mar. 9, 2016

(65) Prior Publication Data

US 2016/0324222 A1 Nov. 10, 2016

Related U.S. Application Data

(63) Continuation-in-part of application No. 29/505,035, filed on May 4, 2015, now Pat. No. Des. 760,472, and a continuation-in-part of application No. 29/505,036, filed on May 4, 2015, now Pat. No. Des. 760,473.

(51) Int. Cl.

| | |
|---|---|
| ***A41C 3/06*** | (2006.01) |
| ***A41C 3/00*** | (2006.01) |
| ***A41C 5/00*** | (2006.01) |

(52) U.S. Cl.

CPC ..... *A41C 3/065* (2013.01); *A41C 3/0007* (2013.01); *A41C 5/005* (2013.01)

(58) Field of Classification Search

CPC .. A41C 3/00; A41C 3/065; A41C 3/06; A41C 3/014; A41C 3/0028; A41C 3/005; A41C 3/0057; A41C 3/0064; A41C 3/0071; A41C 3/0078; A41C 3/02; A41C 3/04; A41C 3/10; A41C 3/123; A41C 3/142; A41C 3/144; A41C 3/148

USPC ..... 450/81, 14–17, 23, 25, 30, 31, 27, 28, 450/54–58, 79, 85, 64

See application file for complete search history.

(56) References Cited

U.S. PATENT DOCUMENTS

| | | | | | |
|---|---|---|---|---|---|
| 2,869,553 | A * | 1/1959 | D'Or | A41C 3/065 | 450/81 |
| 3,280,818 | A * | 10/1966 | Pankey | A41C 3/065 | 450/81 |
| 3,934,593 | A * | 1/1976 | Mellinger | A41C 3/065 | 428/355 R |
| 5,998,693 | A * | 12/1999 | Zagame | A61F 13/145 | 450/81 |
| 6,015,332 | A | 1/2000 | Lee | | |
| 6,231,423 | B1 | 5/2001 | Deal | | |
| D462,153 | S | 9/2002 | Nadsady | | |

(Continued)

*Primary Examiner* — Gloria Hale

(74) *Attorney, Agent, or Firm* — Arthur Freilich

(57) ABSTRACT

A bra comprised of separate left and right breast support members where each breast support member comprises a section of flexible sheet material formed to define a concave cavity and having tabs projecting radially outwardly from the cavity rim. Each breast support member defines a rear facing surface encompassing the cavity and tabs, which carries a pressure sensitive adhesive for adhering to a user's skin. The concave cavity constitutes a cup for accommodating the user's breast while the tabs enable the user to readily manipulate the support member for optimally positioning the user's breast relative to the cut of a deep plunge garment.

11 Claims, 3 Drawing Sheets

(56) References Cited

U.S. PATENT DOCUMENTS 6,544,100 B1 4/2003 Nadsady
6,857,935 B1 * 2/2005 Dohan ..... A41C 3/065 2/244
7,001,241 B2 * 2/2006 Gorringe ..... A61F 13/141 450/37
7,163,433 B2 1/2007 Chou
7,229,335 B2 6/2007 Davis
7,278,899 B2 10/2007 Davis
7,335,086 B1 * 2/2008 Karon ..... A41C 3/065 450/1
7,905,763 B1 * 3/2011 Frank ..... A41D 27/12 450/37
8,029,332 B2 10/2011 Deal
D665,971 S * 8/2012 Chang ..... D2/706
D666,385 S 9/2012 Deal
D666,386 S 9/2012 Deal
8,936,504 B2 1/2015 Deal
2005/0079796 A1 * 4/2005 Chou ..... A41C 3/065 450/81
2006/0057938 A1 * 3/2006 Huang ..... A61F 13/141 450/81
2006/0089085 A1 * 4/2006 Ruggiero ..... A41C 3/06 450/81
2009/0117825 A1 * 5/2009 Lutzi ..... A41C 3/065 450/81
2009/0149114 A1 * 6/2009 Horton ..... A41C 3/065 450/54
2010/0023122 A1 * 1/2010 Young ..... A61B 90/39 623/7
2010/0069869 A1 * 3/2010 Johnston ..... A61F 13/141 604/385.02
2010/0180359 A1 * 7/2010 Andrews ..... A41B 9/002 2/69
2012/0266348 A1 * 10/2012 Meginnis ..... A41B 17/00 2/69
2014/0256221 A1 9/2014 Liang

* cited by examiner

ADHESIVE BRA CONSTRUCTION FOR DEEP PLUNGE APPAREL

RELATED APPLICATIONS

This application is a continuation in part of U.S. application Ser. Nos. 29/505,035 and 29/505,036, both filed on 4 May 2015.

FIELD OF THE INVENTION

This invention relates generally to women's underclothing and more particularly to a backless strapless bra especially suited for use with garments having deep plunge necklines.

BACKGROUND OF THE INVENTION

Women's garments having deep plunge necklines are often designed to reveal an upper inner portion of a wearer's breast but conceal the areola and lower breast area. Many women prefer to wear a bra to enhance comfort and appearance but most conventional bra designs are incompatible with such plunge garments because the garment fails to conceal the bra. Similarly, other garments having low backs or minimal shoulder coverage are incompatible with conventional bra designs having back and/or shoulder straps.

U.S. Pat. No. 5,755,611 partially addresses the problem by describing a bra design intended to resolve the > "need for a self-supporting breast cup that is pre-formed in the shape of different breast sizes (including left and right) and provides the requisite support for the breast without using hooks and straps, that can be reused several times, that is comfortable to wear, that has a soft natural shape, that can accommodate today's plunge-line fashions, that feels like skin and that does not disturb the contour of the woman's torso with unwanted protuberances, thereby providing a natural yet supportive appearance to a woman's bust."

The present invention addresses essentially the same "need" but provides improved breast support members offering greater user convenience and enhanced versatility.

SUMMARY OF THE INVENTION

The present invention is directed to a bra comprised of separate left and right breast support members where each breast support member comprises a section of flexible sheet material formed to define a concave cavity and having tabs projecting radially outwardly from the cavity rim. Each breast support member defines a rear facing surface, preferably encompassing the cavity and tabs, which carries a pressure sensitive adhesive for adhering to a user's skin. The concave cavity constitutes a cup for accommodating the user's breast while the tabs enable the user to readily manipulate the support member for optimally positioning the user's breast relative to the cut of the intended garment.

In a preferred embodiment, each breast support member section has a periphery which includes an arcuate inner segment and a curving outer segment. The peripheral segments form the aforementioned tabs which preferably include a central tab and oppositely directed upper and lower tabs. The central tab extends laterally in a direction away from the cup. The oppositely directed upper and lower tabs are oriented essentially perpendicular to the central tab.

Each breast support member is intended to be worn so as to partially cover the breast, while exposing an upper inner portion of the breast. For convenience of description herein, a typical breast will be considered as having an inner surface portion (i.e., proximate to the sternum), an outer surface portion (i.e., proximate to the arm), and a bottom surface portion extending between the inner and outer surface portions.

A preferred breast support member in accordance with the invention is intended to be worn so as to primarily cover the breast outer surface and bottom surface portions while leaving the inner surface portion at least partially exposed. The central tab which extends toward the user's side and arm can be readily manipulated by the user to laterally position the breast prior to adhering the tab to the user's skin. The upper tab, directed toward the user's shoulder, can be readily manipulated to lift, i.e., vertically position, the breast prior to adhering the tab to the user's skin. The lower tab is intended to be adhered to the user's skin directed toward the user's waist to retain the breast in the desired lift position.

Each breast support member comprises a flexible sheet-like structure preferably formed of at least two layers sandwiching a foam pad therebetween. Each breast support member is preferably formed by applying adhesive and/or pressure to the stack of layers and foam pad to fuse the layers together. A reusable pressure sensitive, skin compatible adhesive, e.g., silicone, is applied to the exposed rear facing surface of the stack for subsequent adhesion to a user's skin.

In typical use, the wearer will place her breast in the breast cup and then by manually manipulating the tabs move the breast as desired for optimal lateral and vertical positioning relative to the cut, e.g., plunge neckline, of the garment to be worn. After satisfactory positioning, the tabs will be pressed against and adhered to the user's skin.

In accordance with a significant feature of a preferred embodiment, a stiffener member, preferably a flat flexible plastic strip, is embedded in the foam material near the outer rim of the cavity and proximate to the central and lower tabs.

DETAILED DESCRIPTION

Figure 1:
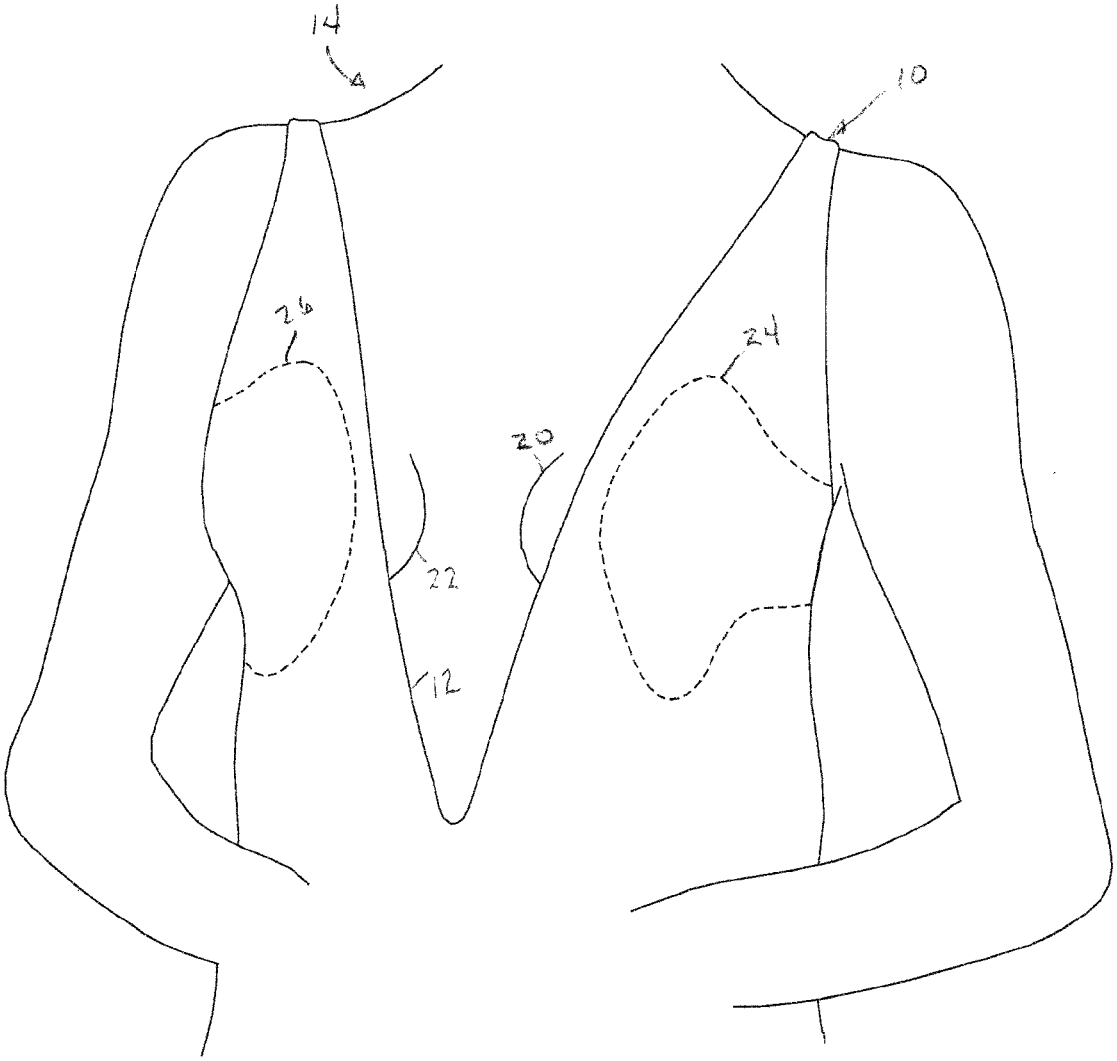
FIG. 1 schematically depicts a female torso showing how an embodiment of the present invention functions with a deep plunge garment.
Figure 5:
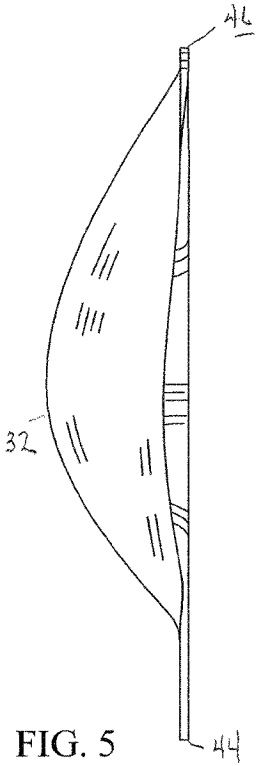
FIG. 5 is a right side view of the breast support member of FIG. 2.

FIG. 1 schematically depicts an exemplary garment 10 having a deep plunge neckline 12 worn by a female torso 14. Frequently, such garments are cut and worn so as to expose the inner portions of the wearer's left and right breasts 20, 22. The cut of garment 10 makes it generally incompatible for use with traditional bras which would be unattractively exposed by the plunge neckline 12.

The present invention is directed to a bra particularly suited for use with deep plunge garments which affords appropriate breast support and user comfort while remaining concealed by the garment. A bra in accordance with the invention is comprised of separate left and right breast support members 24, 26 represented in FIG. 1 by hidden dash line under garment 10. Each breast support member 24, 26 is configured to enable a wearer to readily orient and retain a breast in a selected lateral and vertical position to optimize the wearer's comfort and appearance. The term "lateral" positioning as used herein refers to horizontal positioning of a breast to increase or decrease separation between the left and right breasts. The term "vertical" positioning as used herein relates to what is sometimes referred to as "lift".

As will be discussed hereinafter, a breast support member in accordance with the invention relies on a pressure sensitive adhesive, preferably silicone, applied to the rear facing surface of the support member for adherence to the user's skin to retain the breast in the position selected by the user.

Figure 2:
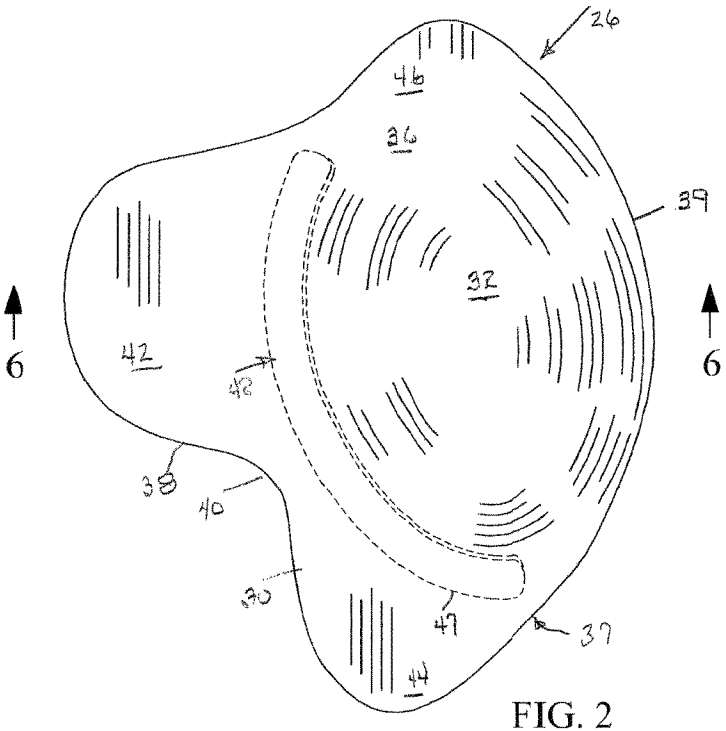
FIG. 2 is a top plan view of a breast support member in accordance with the invention.
Figure 3:
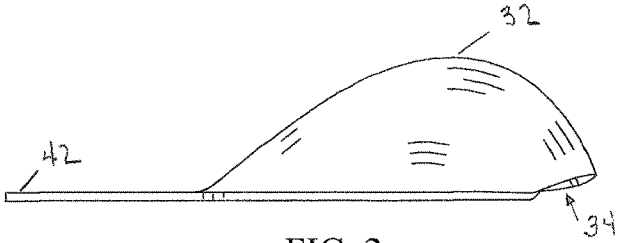
FIG. 3 is a lower side view, partially broken away, of the breast support member of FIG. 2.
Figure 4:
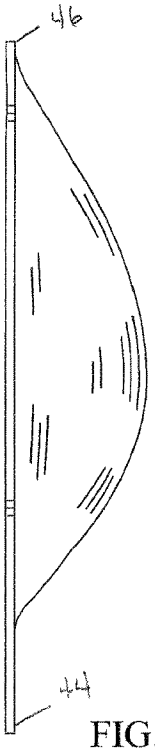
FIG. 4 is a left side view of the breast support member of FIG. 2.

Attention is now directed to FIGS. 2-5 which illustrate a preferred embodiment of the right breast support member 26 of FIG. 1. The left breast support member 24 is the mirror image of member 26 but otherwise identical. The support member 26 comprises a section of flexible sheet material 30 formed to define a breast cup 32 including a concave cavity 34 (FIG. 6) in its rear facing surface 35 for accommodating a user's breast 22. FIG. 2 depicts a top view showing the convex front facing surface 36 of support member 26 including the convex surface of cup 32 and the contiguous flange 37.

The sheet material section 30 is preferably formed of two or more layers to be discussed hereinafter. Significantly, the flange 37 has a periphery 38 essentially comprised of an arcuate inner segment 39 (intended for placement nearer to the wearer's sternum) and a curving outer segment 40 (intended for placement nearer to the wearer's arm). The curving outer segment 40 defines a projecting central tab 42 which enables the wearer to readily pull the section 30, along with cup 32, laterally to orient the wearer's breast. The flange 37 also defines a projecting lower tab 44 and upper tab 46, both oriented substantially perpendicular to central tab 42, which enable the wearer to pull the section 30 and cavity 34 vertically to selectively lift the wearer's breast.

As represented by the dash/hidden line 47 in FIG. 2, a stiffener member 48 is incorporated into section 30, placed proximate to or coincident with the outer rim of the cavity 34, i.e., essentially at the transition between the cavity and flange 37. Note that the stiffener member 48 extends across both the central tab 42 and lower tab 44.

Figure 6:
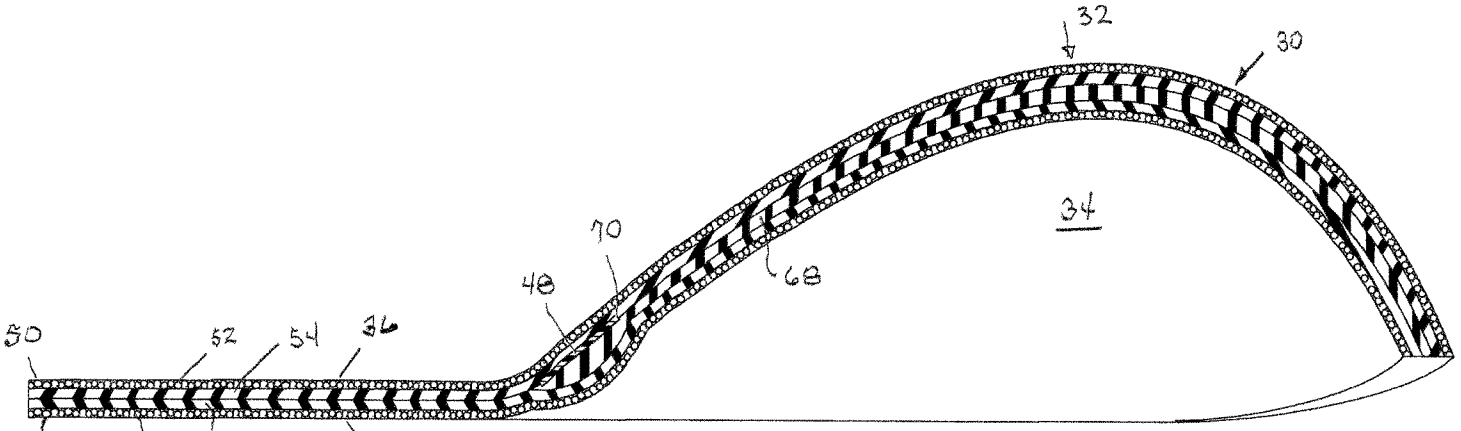
FIG. 6 is a sectional view taken substantially along the plane 6-6 of FIG. 2.

FIG. 6 depicts a preferred section 30 in accordance with the invention showing it being comprised of multiple layers. More particularly, the section 30 includes a top layer 50 comprising a fabric laminate 52 fused to a thin foam laminate 54. The outer surface 56 of fabric laminate 52 constitutes the front facing surface 36 of support member 26.

The section 30 further includes a bottom layer 60 comprising a fabric laminate 62 fused to a thin foam laminate 64. The outer surface 66 of fabric laminate 62 constitutes the rear facing surface 35 of support member 26. As shown, both top layer 50 and bottom layer 60 are formed (for example molded by heat and pressure) so as to define the breast cup 32 including the concave cavity 34. A foam pad 68 is preferably sandwiched between the foam laminates 54 and 64. Also, a stiffener member 48 preferably comprising a flat plastic strip 70 is retained between the foam pad 68 and the foam laminate 54. The strip 70 is configured to be relatively flexible around a line across the strip width and relatively stiff around a line along the strip length.

Figure 7:
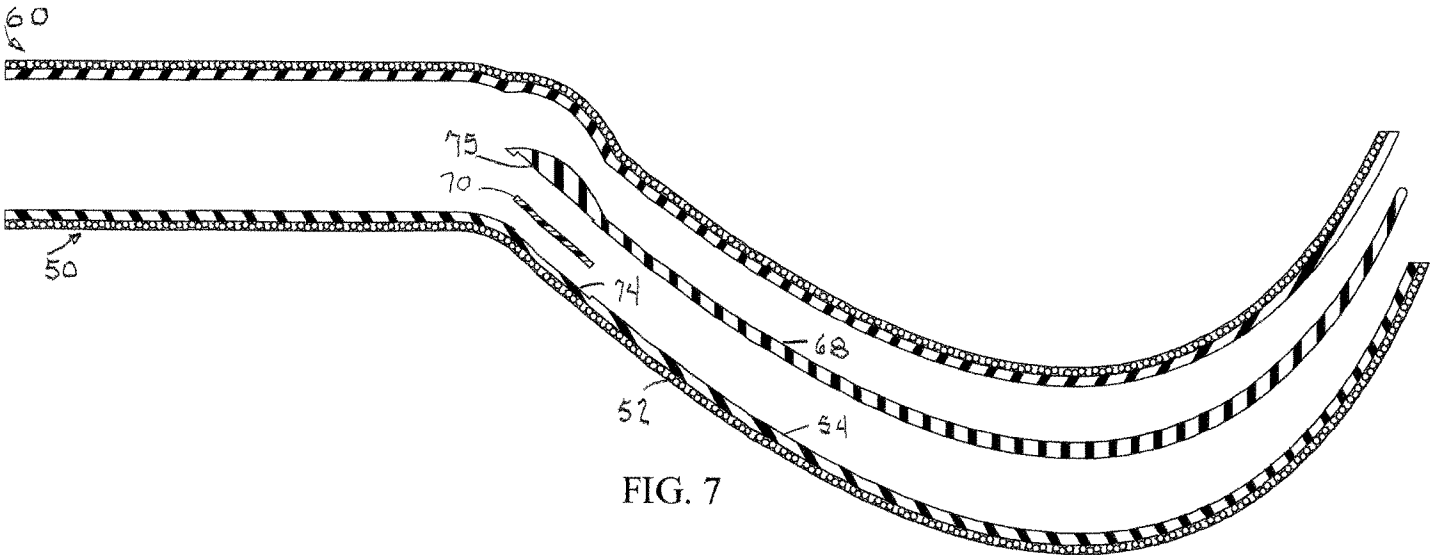
FIG. 7 is an exploded sectional view of the breast support member of FIG. 6.

FIG. 7 comprises an exploded view of the breast support member of FIG. 6 to better explain a preferred fabrication procedure. Initially, the top layer 50 is placed in a heat mold (not shown) to form the concave curve including a recess 74 for partially accommodating the strip 70. A formed foam pad layer 68 having a mating recess 75 is stacked against the foam laminate 54 to lock strip 70 therebetween. Then the bottom layer 60 is conformed and stacked to the top layer and foam pad 68. The stacked layers are adhered together by introducing adhesive between the layers and/or by fusing the respective layers by the appropriate application of heat and pressure.

Precise dimensions and materials used to fabricate the breast support member 26 of FIGS. 6 and 7 can vary considerably. It has been found appropriate however that each layer 50, 60 comprise a fabric or silicone laminate 52, 62. The fabric laminate can be comprised of a variety of materials, for example, approximately 82% nylon and 18% polyester, fused to a thin foam laminate 54, 64 on the order of 1 mm thick. The strip 70 is approximately 0.8 mm thick, ⅜ inches wide, and 4-5 inches long. A skin compatible reusable silicone adhesive is applied to the rear facing surface 35 of fabric laminate 62 and, for the user's convenience, can be packaged with a removable protective release sheet (not shown).

In production, the breast support members can be provided in various cup sizes, e.g., A, B, C, D. The peripheral dimensions of the section 30 will preferably vary with cup size but typically will have an overall vertical dimension on the order of 7-9 inches and a lateral dimension on the order of 6-8 inches.

In typical use, the wearer will place the support member 26 cup over her breast with the stiffener member 70 proximate to the breast outer surface portion. Then, by manipulating the central tab 42, the wearer can laterally move the breast to achieve the desired breast cleavage/separation. Additionally, by manipulating the upper tab 46, the wearer can move the breast vertically to achieve the desired lift. When the breast is positioned as desired, the tabs and cup are pressed against the wearer's skin to adhere the support member 26.

From the foregoing, it should now be understood that a bra construction has been described particularly suited for use with deep plunge garments comprised of separate left and right breast support members where each support member comprises a section of flexible sheet material formed to define a concave breast accommodating cavity bounded in party by a stiffener member embedded in the sheet material. Each support member defines tabs extending radially outward from the cavity rim. The tabs define a rear facing surface carrying a reusable pressure sensitive adhesive for adhering to a user's skin. Although only a single embodiment has been described, it should be recognized that variations and modifications falling within the intended scope of the appended claims may readily occur to those skilled in the art.

What is claimed is:

1. A bra especially configured for use with garments having a plunge neckline, said bra comprising:

a left breast support member for covering a wearer's left breast outer and bottom surface portions while leaving an inner surface portion exposed, said support member comprising a section of sheet material having a front facing surface and a rear facing surface formed to define a cup comprising a cavity in said rear facing surface for accommodating a wearer's left breast; said sheet material section forming a flange around said cup having a periphery including an arcuate segment adjacent a first side of said cup for placement near a wearer's left breast inner surface portion, a central tab adjacent a second side of said cup projecting in an outward direction away from said arcuate segment for enabling lateral positioning of said accommodated breast, and an upper tab projecting outwardly from said cup oriented substantially perpendicular to said central tab; a stiffener member incorporated in said sheet material section extending between said cup and said central tab for enabling vertical positioning of said accommodated breast; and wherein said rear facing surface carries a pressure sensitive adhesive for adhering to a wearer's skin; and a right breast support member for covering a wearer's right breast outer and bottom surface portions while leaving an inner surface portion exposed, said support member comprising a section of sheet material having a front facing surface and a rear facing surface formed to define a cup comprising a cavity in said rear facing surface for accommodating a wearer's right breast; said sheet material section forming a flange around said cup having a periphery including an arcuate segment adjacent a first side of said cup for placement near a wearer's right breast inner surface portion, a central tab adjacent a second side of said cup projecting in an outward direction away from said arcuate segment for enabling lateral positioning of said accommodated breast, and an upper tab projecting outwardly from said cup oriented substantially perpendicular to said central tab for enabling vertical positioning of said accommodated breast; a stiffener member incorporated in said sheet material section extending between said cup and said central tab; and wherein said rear facing surface carries a pressure sensitive adhesive for adhering to a wearer's skin.

2. The bra of claim 1 wherein said left breast support member further includes a lower tab projecting outwardly from said cup in a direction opposite to the upper tab thereof; and said right breast support member further includes a lower tab projecting outwardly from said cup in a direction opposite to the upper tab thereof.

3. The bra of claim 2 wherein said left breast support member stiffener member extends between said cup and said lower tab; and wherein said right breast support member stiffener member extends between said cup and said lower tab.

4. The bra of claim 1 wherein each of said stiffener members comprises an elongate flat strip having a length and width and configured to be relatively flexible around a line across the strip width and relatively stiff around a line along the strip length.

5. The bra of claim 1 wherein said sheet material of each of said support members is comprised of front and rear layers sandwiching foam material therebetween.

6. A bra especially configured for use with a garment having a plunge neckline, said bra comprising left and right breast support members for respectively partially covering a wearer's left breast and right breast, each support member comprising:

a section of sheet material having a front facing surface and a rear facing surface formed to define a cup comprising a cavity in said rear facing surface configured to accommodate a wearer's breast;

said sheet material section forming a flange around said cup having a periphery including an arcuate segment adjacent an inner side of said cup for placement near a wearer's breast inner surface portion, a central tab adjacent an outer side of said cup projecting in an outward direction away from said arcuate segment for enabling a wearer to laterally position said support member, and an upper tab projecting outwardly from said cup oriented substantially perpendicular to said central tab for enabling a wearer to vertically position said support member;

a stiffener member incorporated in said sheet material section extending between said cup and said central tab; and wherein said rear facing surface carries a pressure sensitive adhesive for adhering to a wearer's skin.

7. The bra of claim 6 wherein each breast support member further includes a lower tab projecting outwardly from said cup in a direction opposite to said upper tab.

8. The bra of claim 7 wherein each support member stiffener member extends between the cup and lower tab thereof.

9. The bra of claim 6 wherein each stiffener member comprises an elongate flat strip having a length and width and configured to be relatively flexible around a line across the strip width and relatively stiff around a line along the strip length.

10. The bra of claim 6 wherein said sheet material of each of said support members is comprised of front and rear layers sandwiching foam material therebetween.

11. A method of supporting a user's breast under a garment having a plunge neckline so as to cover the outside and bottom surface portions of the breast while partially exposing the breast inner surface portion, said method comprising:

providing a breast support member comprising a section of sheet material having a front facing surface and a rear facing surface and a concave cavity extending into said rear facing surface and wherein said sheet material forms a flange extending around said cavity having a periphery including an arcuate segment proximate to a first side of said cavity and a central tab proximate to a second side of said cavity projecting away from said cavity and an upper tab projecting away from said cavity and oriented substantially perpendicular to said central tab and wherein said rear facing surface bears a reusable adhesive;

placing the user's breast in said support member cavity with said arcuate segment placed near the breast inner surface portion while leaving said inner surface portion at least partially exposed;

manipulating said central tab to laterally position the user's breast to a location exposing the breast inner surface portion within said plunge neckline;

manipulating said upper tab to vertically position the user's breast relative to said plunge neckline; and pressing the rear facing surface of said breast support member against said user's for adhering said support member to said user's skin.

* * * * *